United States Patent [19]

Lersmacher et al.

[11] 4,250,429

[45] Feb. 10, 1981

[54] ELECTRON TUBE CATHODE

[75] Inventors: Bernhard Lersmacher, Aachen; Hans Lydtin, Stolberg; Horst Seifert, Hamburg, all of Fed. Rep. of Germany; Johannes W. A. Krol, Valkenswaard, Netherlands

[73] Assignee: U.S. Philips Corporation, New York, N.Y.

[21] Appl. No.: 845,274

[22] Filed: Oct. 25, 1977

[30] Foreign Application Priority Data

Nov. 5, 1976 [DE] Fed. Rep. of Germany ..... 2650656

[51] Int. Cl.[3] ..... H01J 1/13

[52] U.S. Cl. ..... 313/346 R; 252/511; 313/311

[58] Field of Search ..... 313/346 R, 346 DC, 310, 313/311; 29/25.17, 25.18; 252/502, 511

[56] References Cited

U.S. PATENT DOCUMENTS

| | | | |
|---|---|---|---|
| 3,454,816 | 7/1969 | Hoffmann et al. | 313/346 R |
| 3,856,574 | 12/1974 | Amagi et al. | 252/502 X |

*Primary Examiner*—Eugene R. LaRoche

*Attorney, Agent, or Firm*—Thomas A. Briody; Robert T. Mayer; Paul R. Miller

[57] ABSTRACT

Cathodes having a support for emissive material of foamed carbon are mechanically stable and resistant to detrition and have a homogeneous pore distribution.

19 Claims, 12 Drawing Figures

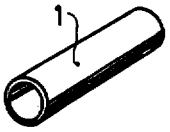
Fig.1
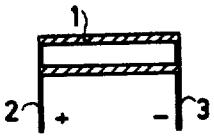
Fig.2
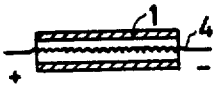
Fig.3
Fig.4
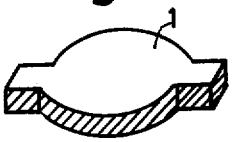
Fig.6
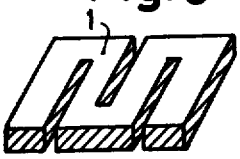
Fig.8
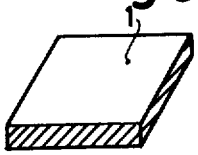
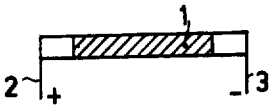
Fig.5
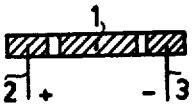
Fig.7
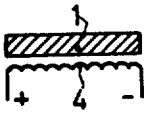
Fig.9
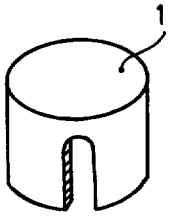
Fig.10
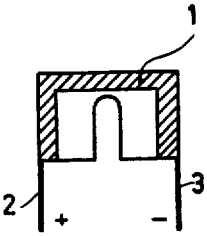
Fig.11
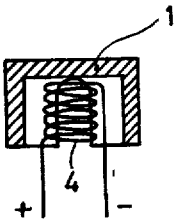
Fig.12

ELECTRON TUBE CATHODE

The invention relates to an electron tube cathode having a porous carbon body and a support for the emissive material.

German patent Specification No. 836,528 discloses an electrode for discharge tubes which consists of a carbon body formed by carbonization of a material which maintains its structure. The starting material used in the manufacture of the electrode is of a predominantly organic nature, for example wood or fabric, which is converted into porous carbon and which maintains the structure already present prior to carbonization. Carbonization may take place by dry distillation. Prior to the carbonization, the body is already given such dimensions that after the carbonization, which in many cases causes a certain shrinkage of the material, the dimensions correspond to the desired values.

German patent Specification No. 873,872 discloses a cathode for electric discharge tubes in which materials emitting at the operating temperature of the cathode from an emission stock migrate to the cathode surface through fine apertures in a jacket covering the emission stock. The jacket may be formed by a porous carbon body.

German patent Specification No. 949,361 discloses a cathode for electric discharge tubes in which materials emitting from a stock of emissive material at the operating temperature of the cathode land on the cathode surface through fine apertures in a support for the emissive material covering the emission stock and spread by migration. The support for the emissive material may be formed from a porous carbon body. In the interior and/or at the surface of the support for the emissive material, inclusions or coatings are present which comprise one or more of the elements silicon, titanium, aluminium, iron, magnesium or calcium.

German Auslegeschrift No. 1283401 discloses an indirectly heated cathode for high power electron tubes having a support for the emissive material. As in a metal cathode having a capillary structure, the support for the emissive material consists of a porous disc which receives the emission stimulating material from the dispenser cathode. The porous supporting disc for the emissive material consists of a porous carbon disc which may have, as an emissive base layer, a metal coating, for example, of platinum. According to German Auslegeschrift No. 1283403 there is present between the porous carbon layer and the metal coating an intermediate layer of a material having a high thermal stability, for example carbides of the metals molybdenum, tungsten, tantalum, zirconium or titanium.

German patent Specification No. 1614686 discloses a directly heated dispenser cathode for electric discharge tubes operating in the manner of a closed diode, in which the cathode of the diode is an indirectly heated metal cathode having capillary structure on the basis of barium and the anode of the diode consists of a porous carbon body which is impregnated with thorium oxide. According to German Offenlegungsschrift No. 17 64 887 the impregnation is carried out by soaking the porous carbon body with a metal organic thorium compound dissolved in an organic solvent and subsequent decomposition in air and annealing in vacuum.

"Angew. Chem." 82 (1970), p. 406 describes two kinds of carbon, namely highly porous carbon and foamed carbon. Carbon bodies which consist of open pores of a very uniform structure for up to 75% of their volume can be manufactured from microcrystalline cellulose without a binder. Foamed carbon bodies are obtained by the carbonization of foamed synthetic resins. As starting materials serve rigid foam materials of synthetic resin having open pores. Two kinds of foamed carbon are known:

(a) foamed carbons having a net-like (reticular) structure as described, for example, in German Offenlegungsschrift No. 24 53 204, and (b) foamed carbons having a cellular structure, so called syntactic foamed materials, described, for example, in "Carbon 10" (1972), pp 185–190.

The above-described electrodes and parts of electrodes, respectively, of porous carbon have the following drawbacks:

(a) they are not very stable mechanically; this applies in particular to electrodes of porous charcoal. In the case of carbon fabrics, special structural or preparatory measures are necessary for them to be used as an electrode material as a result of the lack of rigidity. Such materials tend more or less to form grindings in the form of small carbon particles. As a result of this, depending on the type of electrode, the function of an electron tube, for example also the high voltage stability thereof, may be adversely affected. This is particularly true in the case of high power tubes since the electrodes of such tubes are generally subjected to strong thermal shock loads, and hence to rapid temperature variations.

(b) The pores in the porous materials—perhaps with the exception of certain fabrics—are distributed comparatively inhomogeneously. In addition, particularly with the synthetic grafite types, they are partly very difficult of access. As a result of this, the impregnation of such porous electrodes with a second and/or third material phase, for example by gaseous phase processes, e.g. chemical vapour deposition, or by liquid infiltration, is impeded. Such impregnations are necessary to ensure a supply of materials stimulating the emission in filament cathodes.

It is the object of the invention to provide a cathode of the kind mentioned in the preamble which is mechanically stable and resistant to detrition and which has a homogeneous pore distribution.

According to the invention this is achieved in that the porous carbon body consists of foamed carbon.

In a preferred embodiment of the invention the porous carbon body consists of foamed carbon having a netlike structure. In another preferred embodiment of the invention the porous carbon body consists of a syntactic foamed carbon. When starting from netlike foamed materials as well as from materials which result in syntactic foamed carbon, porous constructions are obtained having pore characteristics which can be freely varied within a very large range of the total pore volume of, for example, approximately 90 to 40%. "Pore characteristic which can be freely varied" as used herein is also to be understood to mean that the shape of the pores (spherical, polyhedron, cylindrical ducts, etc.), the average size and distributions thereof, the extent of mutual bonding and hence the "transparency of the porous electrode body" can be varied at will within wide limits. It is of particular importance that the method of manufacturing foamed bodies according to the invention on the basis of macroporous carbons can take place so that the total, and therefore also the inner, pore volume is easy of access. As a result of this, the process of impregnation with a second (and third) material phase can also be adapted optimally, of which a few examples will be described hereinafter. As already explained explicitly elswhere ("Philips Technisch Tijdschrift" 36 (1976), No 4 pp. 109–119—in which also all the important steps of the manufacture of reticular foamed materials are described—), considerable values of compression strength and shear stress (for example compression strengths of approximately 110 kg/cm$^2$ and shear stresses of approximately 100 kg/cm$^2$ for a reticular foamed material having an overall pore volume of approximately 75%) are also obtained for highly porous foamed forms.

The foamed plastic bodies, on which the present invention is based, have proved to be very resistant to detrition. This is a result of their structural characteristics which are inherent in the carbon as such having a vitreous paracrystalline character.

In a further preferred embodiment of the invention a porous carbon body is used as a support for the emissive material as it is obtained by carbonization of hard fabrics of phenol aldehyde resin. Such hard fabrics are stratified fabrics which consist of cotton fabrics impregnated, for example, with phenol or cresol formaldehyde resins. Their carbonization provides a mechanically very strong porous carbon which has the most important characteristics of the vitreous carbon. In addition to the already mentioned mechanical stability and a high resistance to detrition, its particular advantages for use as a cathode body mainly reside in the regularly formed pores which are uniformly provided in the volume and which are bonded together by fine ducts. This material whose manufacture is described in German patent Application P 26 48 900.9, as well as the other mentioned porous carbons, can readily be impregnated with the emission-stimulating materials by geaseous phase infiltration and, in particular, by liquid infiltration. Moreover, the starting material, as well as the carbonized final product, can be readily processed.

It has been found that all the above-described electrode-types, shapes and parts can be manufactured from foamed carbon. The surface of the carbon body may be covered at least partly with metals, for example tungsten, zirconium or tantalum. It is even more favourable when the carbon body is impregnated in addition with emissive material. Such impregnations may be carried out, for example, by reactive deposition of metal and of emissive material from the liquid phase or the gaseous phase (CVD method). For example, thorium oxide in powder form is preferably also added to the starting materials during the manufacture of the synthetic resin foam. This oxide is not varied by the pyrolysis process during the carbonization of the polymeric starting material; it may be converted into the emission-stimulating thorium at high temperatures with the carbon of the foamed material while forming CO and/or $CO_2$.

A characteristic of the above-mentioned net-like foamed carbon is that by the action of external forces, for example by providing masses or the partial compression of the impregnated but not yet cured polymeric starting foamed material during thermal curing, a deformation of the pore channels can thus be obtained so that preferred directions occur during operation of the cathode for the transport of the emission-stimulating material. Therefore, due to the compression, an anisotropic body is formed with respect to transport processes by increasing the capillary effect.

The invention will now be described with reference to an embodiment and the accompanying drawing.

EXAMPLE

A mixture of phenol resin balloons ("micro-balloons" of Union Carbide, having an average size approximately 10 to 30 μm and a wall thicknesses of approximately 1 μm) with a liquid phenol resin having a starting viscosity of 5000 cP is prepared in the following ratio:

85 parts of phenol resol, 15 parts of "micro-balloons".

After the addition to the starting components of 20% by weight of thorium oxide, the mixture is stirred to a homogeneous paste with the addition of solvents, such as methanol, ethanol, or the like, and a given mould is filled with the mixture. The mixture is then dried for a few hours at temperatures of 40° to 60° C. and solidified. After volatilization of the components, the solidified material is cured at temperatures of 120° C. to 150° C. (These temperatures correspond to the conditions for the quantitative curing of phenol resins). After this treatment, a solid is obtained having a specific gravity of approximately 0.6 to 0.65 g/cm$^3$. This indicates a comparatively high proportion of pores of approximately 50% of the overall volume.

This polymeric macroporous foamed body has the $ThO_2$ added in powder form in a very fine and homogeneous distribution. If necessary, it can be very easily shaped to given shapes by a machining operation. After these process steps, the polymeric foamed body is heated according to known methods for the pyrolysis of solids in an inert atmosphere at temperatures of about 1000° C., preferably 1500° C. to 1600° C. The polymeric part of the body is converted into a "geometrically similar" carbon foamed material with a loss in weight of up to 40% of the starting weight with a linear shrinkage of approximately 25% of the original dimensions.

The reduction of the incorporated $ThO_2$ to Th begins only after a rather long exposure to temperatures of 1600° C. and higher.

The numerical values given in this Example for the starting mixture, the pretreatment and the specific gravity, as well as for the carbonization, are exemplary values which may be varied within wide limits. The same applies to the type of starting materials. For example, some duroplastic resin may also be used as a binder instead of a phenol resol. A method as described, for example, in "Philips Technical Reviews" 36 (1976), No. 4 pp. 93–103 may also be used for the manufacture of a macroporous foamed carbon impregnated with an emission-stimulating material. Instead of a syntactic foamed material, as in this example, a reticular polymeric foamed material having open pores is used as a support for the impregnation mass. The cathode support may also be produced by first making a porous body from foamed carbon. According to known methods this may then be provided with a metallic layer promoting the migration or diffusion, for example, of tungsten, zirconium, molybdenum, tantalum, and so on. Impregnation may then be carried out by means of "CVD" methods, soaking and the like with a material stimulating the emission, for example, with $ThO_2$ or BaO.

Several embodiments of the cathode according to the invention are shown in the drawinag, in which:

FIG. 1 is a perspective view of a cylindrical cathode,

FIG. 2 is a cross-sectional view of a cathode shown in FIG. 1 with direct heating (current passage), FIG. 3 is a sectional view of a cathode according to FIG. 1 with indirected heating, FIG. 4 is a perspective view of the plate-shaped cathode, FIG. 5 is a side elevation of a cathode shown in FIG. 4 with direct heating, FIG. 6 is a perspective view of a plate-shaped cathode in a meander-like construction, FIG. 7 is a side elevation of a cathode shown in FIG. 6 with direct heating, FIG. 8 is a perspective view of a plate-shaped cathode, FIG. 9 is a side elevation of a cathode shown in FIG. 8 with indirect heating, FIG. 10 is a perspective view of a cap-shaped cathode, FIG. 11 is a sectional view of a cathode shown in FIG. 10 with direct heating, and FIG. 12 is a sectional view of a cathode shown in FIG. 10 with indirect heating.

In the figures the bodies of foamed carbon are denoted by 1. The cathode bodies 1 in FIGS. 2, 5, 7 and 11 are supplied with current for direct heating via conductors 2 and 3. In the embodiments shown in FIGS. 3, 9 and 12 a coiled filament 4 serves for indirect heating of the cathode. The meander-like construction of the cathode shown in FIGS. 6 and 7 results in an increased electrical resistance.

The shapes of the cathodes can be varied within wide limits. This also applies to the dimensions of the wall thicknesses (approximately 0.5 mm to 10 mm), lengths and diameters (approximately 3 mm to 100 mm).

What is claimed is:

1. A cathode for an electron tube, said cathode comprising a support made of foamed carbon having a net-like structure and containing an emissive material.

2. A cathode according to claim 1, wherein said support has pore channels which are deformed so that preferred directions are formed for transport of said emissive material during operation of said cathode.

3. A cathode according to claim 1, wherein said support has a surface at least partly coated with a metal.

4. A cathode according to claim 1, wherein said support is impregnated with said emissive material.

5. A cathode according to claim 1, wherein means are included for indirectly heating said support.

6. A cathode according to claim 1, wherein means are included for directly heating said support.

7. A cathode according to claim 1, wherein said emissive material is intermixed with a starting material from which said carbon support is made.

8. A cathode for an electron tube, said cathode comprising a support made of syntactic foamed carbon and containing an emissive material.

9. A cathode according to claim 8, wherein said support has a surface at least partly coated with a metal.

10. A cathode according to claim 8, wherein said support is impregnated with said emissive material.

11. A cathode according to claim 8, wherein means are included for indirectly heating said support.

12. A cathode according to claim 8, wherein means are included for directly heating said support.

13. A cathode according to claim 8, wherein said emissive material is intermixed with a starting material from which said carbon suupport is made.

14. A cathode for an electron tube, said cathode comprising a support made of carbonized rigid phenol aldehyde resin fabric and containing an emissive material.

15. A cathode according to claim 14, wherein said support has a surface at least partly coated with a metal.

16. A cathode according to claim 14, wherein said support is impregnated with said emissive material.

17. A cathode according to claim 14, wherein means are included for indirectly heating said support.

18. A cathode according to claim 14, wherein means are included for directly heating said support.

19. A cathode according to claim 14, wherein said emissive material is intermixed with a starting material from whch said carbon support is made.

* * * * *